US006822175B2

(12) United States Patent
Kondoh et al.

(10) Patent No.: US 6,822,175 B2
(45) Date of Patent: Nov. 23, 2004

(54) LIQUID CONDUCTOR SWITCH DEVICE

(75) Inventors: You Kondoh, TsukiminoYamato (JP); Mitsuchika Saito, Kanagawa (JP); Yoshikatsu Ichimura, Tokyo (JP)

(73) Assignee: Agilent Technologies, Inc., Palo Alto, CA (US)

( * ) Notice: Subject to any disclaimer, the term of this patent is extended or adjusted under 35 U.S.C. 154(b) by 124 days.

(21) Appl. No.: 10/177,281

(22) Filed: Jun. 21, 2002

(65) Prior Publication Data

US 2003/0234167 A1 Dec. 25, 2003

(30) Foreign Application Priority Data

Dec. 22, 1999 (JP) ..... 11-364605

(51) Int. Cl.[7] ..... H01H 29/00; H01H 1/00
(52) U.S. Cl. ..... 200/182; 200/234; 200/235
(58) Field of Search ..... 200/182–236; 335/52; 324/94

(56) References Cited

U.S. PATENT DOCUMENTS 3,657,647 A * 4/1972 Beusman et al. ..... 324/94
3,904,999 A * 9/1975 Rich et al. ..... 335/52
4,103,135 A * 7/1978 Gomez et al. ..... 200/185
5,391,846 A * 2/1995 Taylor et al. ..... 200/233
6,323,447 B1 * 11/2001 Kondoh et al. ..... 200/182

FOREIGN PATENT DOCUMENTS

| | | | |
|---|---|---|---|
| DE | 170 073 C | 4/1906 | |
| JP | 09-161640 | 6/1996 | |
| WO | WO 01/46974 A1 * | 6/2001 | ..... H01H/29/28 |

OTHER PUBLICATIONS

Simon, Jonathan et al., "A Micromechanical Relay with a Thermally–Driven Mercury Micro–Drop", Proceedings of Workshop on Micro Electro Mechanical System, Feb. 11–15, 1996, pp. 515–520.
Simon, Jonathan, et al., "A Liquid–Filled Microrelay with a Moving Mercury Micro–Drop", IEEE, Journal of Microelectrothermal Systems, vol. 6, No. 3, pp. 208–216.

* cited by examiner

*Primary Examiner*—James R. Scott

(57) ABSTRACT

The switch device includes first and second cavities, a passage extending between the cavities, a conductive liquid located in the passage and movable therein, a conductive path that includes the conductive liquid, an actuating liquid enclosed in each of the first and second cavities and covering the inner surfaces thereof and an actuating gas enclosed in each of the first and second cavities and existing as a bubble therein. At least one of the cavities includes a constriction element shaped to constrain the expansion of the actuating gas bubble in the cavity. This limits expulsion of the actuating liquid into the passage and movement of the conductive liquid along the passage.

30 Claims, 7 Drawing Sheets

LIQUID CONDUCTOR SWITCH DEVICE

RELATED APPLICATION

This application is a continuation of International Application under the Patent Cooperation Treaty no. PCT/US00/35097, filed Dec. 22, 2000.

BACKGROUND OF THE INVENTION

An example of a liquid conductor-based switch device is disclosed by Jonathan Simon et al. in A Liquid-Filled Microrelay with a Moving Mercury Drop, 6 IEEE J. OF MICROELECTROMECHANICAL SYSTEMS, 208–216. The disclosed switch device has a pair of cavities that are adjacent each other and connected by a communicating portion. Non-conductive liquid material is tapped inside the cavities. A drop of mercury is located in the communicating portion. A pair of terminals, which are disposed opposite each other, is also provided at the communicating portion. The mercury drop forms an electrical path in conjunction with the terminals.

A heater is provided in each of the pair of cavities. The heater can be turned on to heat the inside of one of the cavities and vaporize the non-conductive liquid material. The vapor forms a bubble inside the cavity. The heating raises the pressure inside the cavity, causing the non-conductive liquid material to push the mercury drop toward the other cavity. As a result of the movement of the mercury drop, an electrical path that is normally in a connected or "on" state is put into a disconnected or "off" state. Conversely, movement of the mercury drop can put an electrical path that is normally in a disconnected state into a connected state.

In this switch design, the non-conductive liquid material cannot be kept in a stable state that is suitable for operation. For example, operation can become unstable when a bubble is unexpectedly generated, such as by a non-uniform change in temperature, and the vapor that makes up the bubble moves undesirably between the cavities. Also, the disclosed switch device does not switch smoothly between the connected and disconnected states.

SUMMARY OF THE INVENTION

In one aspect of the invention, a switch device comprises first and second cavities, a passage extending between the first and second cavities, a conductive liquid located in the passage and movable in the passage, an actuating liquid enclosed in each of the first and second cavities and covering inner surfaces of the first and second cavities, the actuating liquid being either an insulator or having low conductivity, and an actuating gas enclosed in each of the first and second cavities and existing as a bubble in each of the first and second cavities, the actuating gas being either an insulator or having low conductivity. In response to heating of the first cavity, part of the actuating liquid in the first cavity vaporizes and the actuating gas bubble in the first cavity expands, which causes part of the actuating liquid to be expelled out of the first cavity and the conductive liquid to move in the passage such that an electrical path that includes the conductive liquid changes from one of a connected and a disconnected state to the other of a connected state and a disconnected state. The first cavity includes a constriction element shaped to constrain the expansion of the actuating gas bubble in the first cavity.

In another aspect of the invention, a method for switching an electrical path in a switch device having first and second cavities, the first cavity including a constriction element, a passage extending between the first and second cavities, a conductive liquid located in the passage and movable in the passage, an actuating liquid enclosed in each of the first and second cavities and covering inner surfaces of the first and second cavities, the actuating liquid being either an insulator or having low conductivity, an actuating gas enclosed in each of the first and second cavities and existing as a bubble in each of the first and second cavities, the actuating gas being either an insulator or having low conductivity. The method includes vaporizing part of the actuating liquid in the first cavity and expanding the actuating gas bubble in the first cavity in response to heating of the first cavity. The expansion of the gas bubble in the first cavity is constrained by the shape of the constriction element. Part of the actuating liquid is expelled from the first cavity in response to the expansion of the actuating gas bubble in the first cavity. The conductive liquid moves in response to the expulsion of part of the actuating liquid from the first cavity, which puts an electrical path that includes the conductive liquid from one of a connected and a disconnected state to the other of a connected state and a disconnected state.

DETAILED DESCRIPTION OF THE INVENTION

Switch devices in accordance with various aspects of the present invention will now be described through reference to the appended figures.

Figure 1:
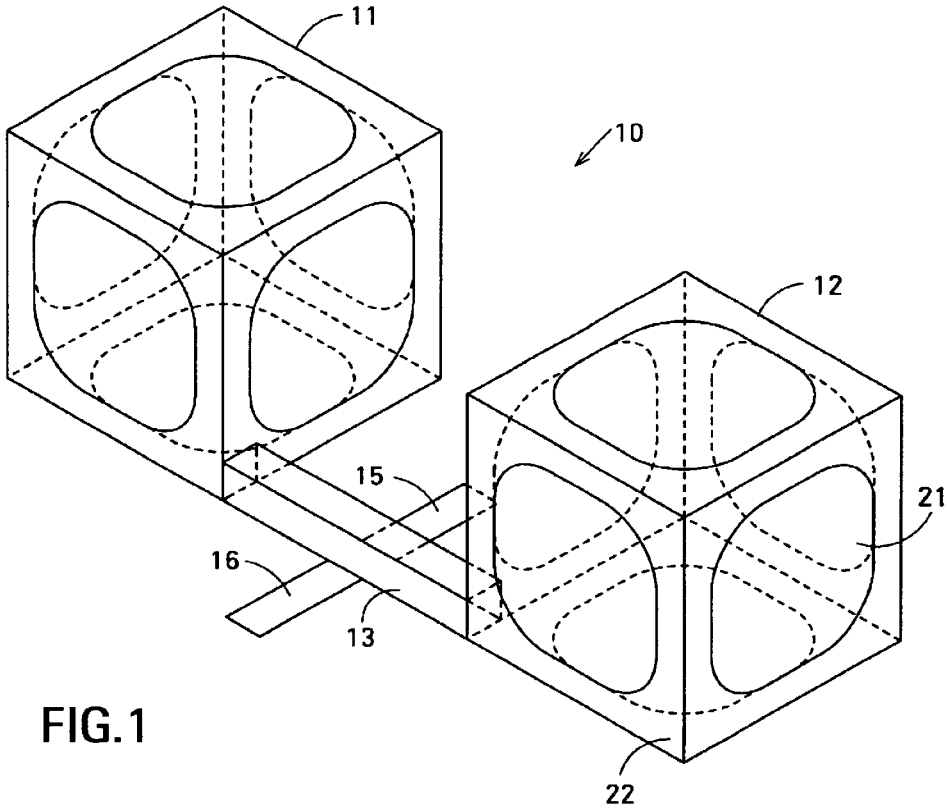
FIG. 1 is a perspective view of a simplified structure of a switch device consistent with the invention.
Figure 2:
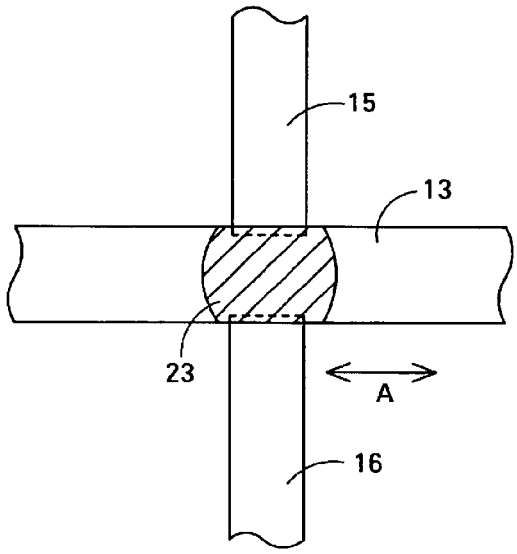
FIG. 2 is a simplified plan view of the structure of the passage extending between the pair of cavities shown in FIG. 1.

In FIGS. 1 and 2, a switch device 10 in a first aspect of the invention has a pair of cavities 11 and 12 and an elongate passage 13, which extends between the cavities 11 and 12 to enable the cavities to communicate with each other. An actuating gas 21 and an actuating liquid 22 are enclosed in each of the cavities 11 and 12. The actuating gas 21 and actuating liquid 22 are preferably maintained in a state of equilibrium within the cavities 11 and 12.

The actuating liquid 22 is preferably a material capable of wetting glass and having a surface tension Γ of less than $7.5\times10^{-2}$ N/m. The actuating liquid 22 may be selected from among liquids that can be easily vaporized by a heater or other form of heat stimulation. For example, the actuating liquid 22 may comprise Freon (a trademark and product E.I. Du Pont de Nemours and Company Corporation), methanol, ethanol, ethyl bromide, acetone, cyclohexane, or other material with similar qualities.

Figure 3:
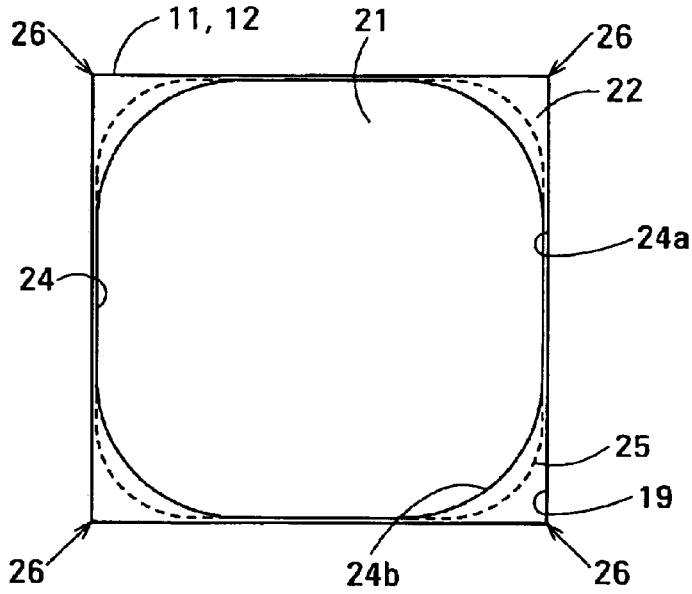
FIG. 3 is a cross-sectional view of one of the cavities shown in FIG. 1, in which the boundary between the liquid phase portion and vapor phase portion is indicated with a solid line for a normal state, and with a broken line for a state of elevated pressure in the vapor phase portion.

The actuating gas 21 may either comprise the same material as the actuating liquid 22 in its vapor phase, or comprise a mixture of the actuating liquid 22 with another gas. As shown in FIG. 3, the actuating gas 21 occupies the majority of the volume of the cavities 11 and 12, while the actuating liquid 22 covers the inner surfaces 19 of the cavities 11 and 12. The cavities 11 and 12 are preferably small enough to enable the actuating liquid 22 to cover the inner surfaces 19 of the cavities 11 and 12 by its own surface tension without being affected by gravity. As a result, the actuating gas 21 exists as a bubble in each of the cavities 11 and 12. The bubble improves the reliability of the operation of the switch device 10, as will be discussed in detail below.

Referring specifically to FIG. 1, the passage 13 has a narrower width than the cavities 11 and 12. A drop 23 of an electrically-conductive liquid is located in the passage 13. As shown by the direction of arrow A in FIG. 2, the drop 23 of conductive liquid can move in the lengthwise direction of the passage 13. The lengthwise direction of the passage 13 will be called the communicating direction. As shown in FIG. 2, terminals 15 and 16 are located on opposite sides of the passage 13 part-way along the length of the passage 13. The drop 23 of conductive liquid may be positioned along the length of the passage 13 at a location where it electrically connects the terminals 15 and 16. It is preferable for the conductive liquid constituting drop 23 to be a liquid metal, such as gallium, mercury, or an alloy that includes gallium, such as GaInSn, GaInSnAg, GaInSnBi, or GaInSnAgBi.

Figure 4:
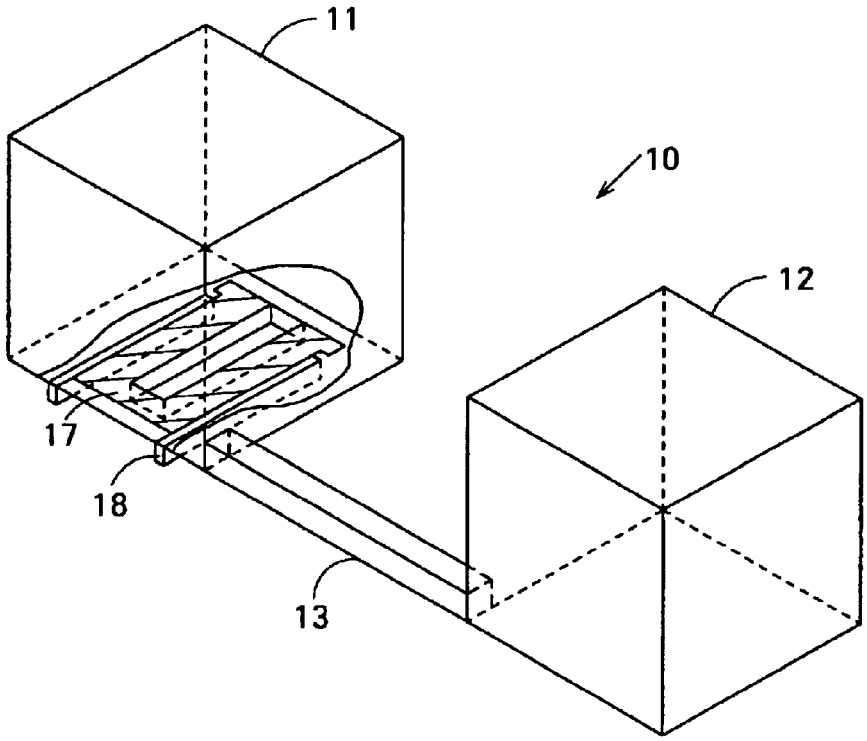
FIG. 4 is a perspective view of a heater for application to the cavity of FIG. 1.

As shown in FIG. 4, a heater 17 is located inside the cavity 11. The heater 17 is shown located at the bottom of the cavity 11, but may be located on another of the sides of the cavity instead. Another heater with the same construction may also be provided inside the cavity 12. The heater 17 serves to heat and vaporize the actuating liquid 22 inside the cavities 11 and 12. The current that flows to the heater 17 for heating may be pulsed. The internal pressure of the cavity 11 is increased by energizing the heater 17 inside the cavity 11 and vaporizing part of the actuating liquid 22. The elevated internal pressure of the cavity 11 causes the drop 23 of conductive liquid to move along the length of the passage 13 toward the cavity 12. As a result of its movement, the drop 23 moves out of contact with either or both of the terminals 15 and 16. The movement of drop 23 opens the electrical circuit formed in a normal state of the switch device 10 by the drop 23 contacting the terminals 15 and 16 and puts the circuit in a disconnected state. Conversely, by turning off the heater 17 in the cavity 11 or by energizing a heater (not shown) in the cavity 12, the drop 23 of conductive liquid can be moved in the opposite direction into contact with the terminals 15 and 16 to restore the normally-connected state of the electrical circuit.

As shown in FIG. 4, the heater 17 may be composed of two heating elements that extend parallel to each other. Grooves 18 that extend parallel to the heater 17 and store additional actuating liquid 22 may also be formed. The actuating liquid 22 fills the grooves 18 through capillary action. As a result, even though the actuating gas 21 fills the majority of the volume of the cavity 11, the actuating liquid 22 can be effectively heated by the heater 17, and the efficiency of vaporization can be improved. The amount of actuating liquid 22 stored in the grooves 18 can be regulated by suitably selecting the depth and width of the grooves 18. By regulating the amount of actuating liquid 22 stored in the grooves 18, the amount of actuating liquid 22 vaporized in a specific time will not exceed a specified maximum even if power to the heater 17 is accidentally left on. As a result, there is no danger of damage to the device in such a situation. The grooves 18 can also be formed in the step of forming grooves 138 and 247 illustrated in FIGS. 5B and 6B, respectively.

As described above, the actuating liquid 22 collects in the corners 26 of the cavities 11 and 12, and the actuating gas 21 is located on the inside of the cavities 11 and 12. The cavities 11 and 12 preferably have a substantially rectangular cross section. The corners 26 are defined by the intersection of two or three of the inside surfaces 19 of the cavities 11 and 12 and serve as constriction elements that constrain the expansion of the actuating gas bubble in the cavities. As shown in FIG. 3, the boundary 24 between the actuating gas 21 and the actuating liquid 22 is aspherical. A boundary portion 24*a* of the boundary, which extends parallel to the inner surfaces 19 of the cavities 11 and 12, is a portion in which deformation of the boundary in response to an increase in pressure of the actuating gas 21 is restricted by the inner surfaces 19. However, a boundary portion 24*b*, which corresponds to the corners 26 of the rectangular inner surfaces 19, is not significantly restricted by the inner surface.

When heat is generated by the heater 17 with the boundary 24 in the state shown by the solid line in FIG. 3, part of the actuating liquid 22 vaporizes, and the pressure of the actuating gas 21 increases. The increased pressure primarily deforms the boundary portion 24*b* outwards, as indicated by the broken line 25 in FIG. 3. The increased pressure expels part of the actuating liquid 22 out of the cavity 11 to move the drop 23 of conductive liquid along the passage 13, as described above. Although not shown in the figures, the volume of the actuating gas 21 inside the actuating liquid 22 is reduced when no heat is applied to the cavity. By providing a bubble of sufficient volume in the one of the cavities 11 and 12 that is not heated, excessive accumulation of the actuating liquid 22 is prevented, and the movement of the drop 23 is smoother.

As heat increases the pressure inside the cavity 11 or 12, the bubble of actuating gas 21 expands and the boundary portion 24*b* is deformed so that its radius of curvature decreases. The surface tension force on the surface of the actuating gas bubble increases approximately proportionally to the decrease in the radius of curvature of the boundary portion 24*b*. The increased surface tension force resists further expansion of the actuating gas bubble, and limits the expulsion of the actuating liquid 22 into the passage 13.

Even when the heater 17 is not energized, heat from the environment may heat the actuating gas 21. When such environmental heating occurs, the resulting increase in the pressure of the actuating gas 21 will deform the boundary portion 24*b* more than the boundary portion 24*a*. Deforming the boundary portion 24*b* will increase the surface tension force on the surface of the actuating gas bubble.

The increasing surface tension force on the surface of the actuating gas bubble constrains further expansion of the gas bubble in one of the cavities 11 and 12 subject to heating, and limits the expulsion of the actuating liquid 22 from the cavity subject to heating into the passage 13. As a result, the switch device 10 according to the invention is highly stable and resists accidental changes in the connection state.

Figure 5A:
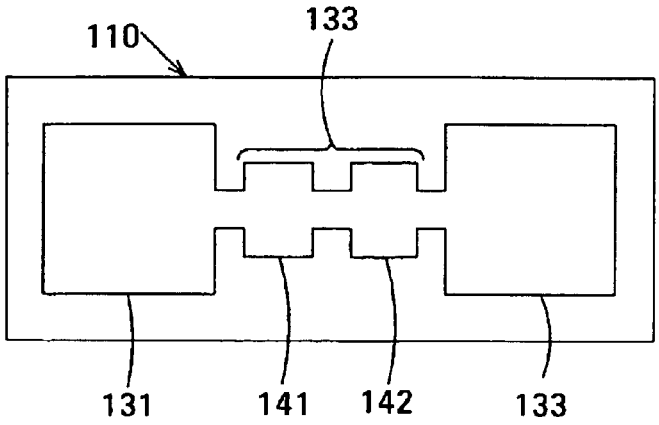
FIGS. 5A and 5B are plan views of the top and bottom, respectively, of glass substrates or sheets used in another switch device consistent with the invention.
Figure 5B:
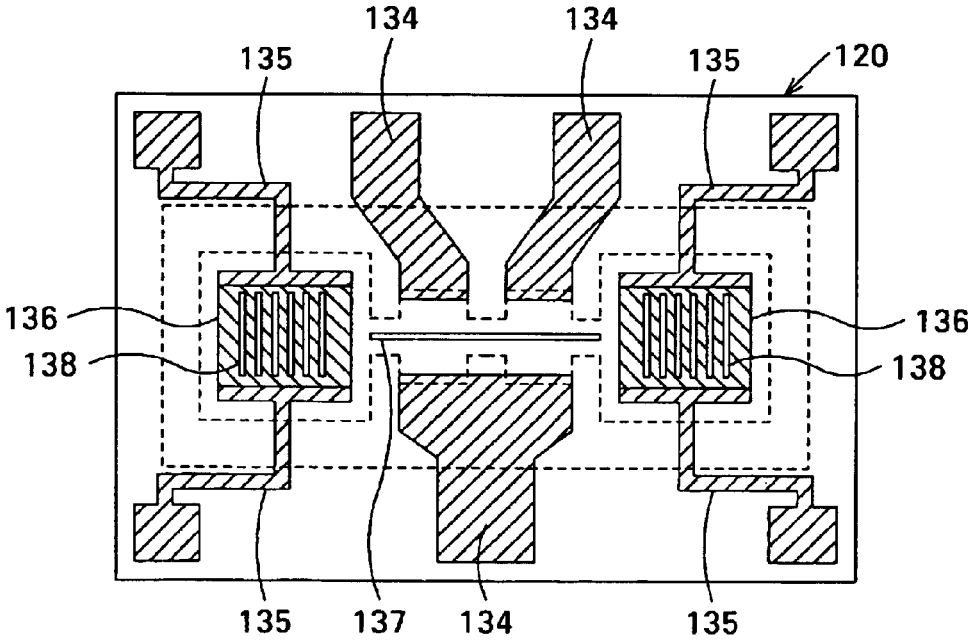

FIGS. 5A and 5B show the glass substrates that form part of a switch device of a second aspect of the invention. FIGS. 5A and 5B show a top and a bottom glass substrate, respectively. In this aspect of the invention, as well as other aspects discussed below, specific structures are disclosed that facilitate manufacturing of the switch device. Since the switch device in these other aspects of the invention operates in the same manner as the switch device of the first aspect of the invention, the operation of the switch device in these other aspects of the invention will not be discussed.

The switch device of the second aspect of the present invention may be manufactured by using the two glass substrates 110 and 120 shown in FIGS. 5A and 5B, respectively, and laying one of them on top of the other. An actuating liquid, an actuating gas, and a conductive liquid (each not shown), which act in the same way as in the first aspect of the present invention, are trapped in channels formed in the glass substrates 110 and 120. These materials and the steps of manufacturing the switch device will be discussed in detail below.

In a first manufacturing step, the glass substrate 110, shown in FIG. 5A, is etched, such as by sandblasting, to form depressions approximately 150 $\mu$m deep. The depressions constitute cavities 131 and 132 and a passage 133, corresponding to cavities 11 and 12 and passage 13 of the switch device 10 described above with reference to FIG. 1. The total length of the cavities 131 and 132 and the passage 133 is approximately 1.05 mm, and the total width of the cavities 131 and 132 is approximately 0.30 mm. Two rectangular chambers 141 and 142 formed in the passage 133 hold the conductive liquid in one of two stable location states and ensure the proper switching connection between the conductive liquid and the electrical traces 134. Specifically, in the completed switch device, the conductive liquid can be latched in either of the chambers 141 and 142. The conductive liquid connects a different electrical circuit path when located in each of the chambers 141 and 142.

In a second step, electrical traces 134 and 135, heaters 136, and grooves 137 and 138 are formed in and on the glass substrate 120. The electrical traces 134 serve to form an electrical path in conjunction with the conductive liquid, and the electrical traces 135 serve to connect the heaters 136 to power sources. The electrical traces 134 and 135 and the heater 136 may be formed by known conductive film formation and patterning methods. The electrical traces 134 and 135 may be formed by patterning a tungsten film, while the heaters 136 may be formed by patterning a tantalum nitride film, for example.

The groove 137 disposed parallel to the long edges of the substrate 120 and located to communicate with the passage 133 when the switch device is assembled enables the actuating liquid to move through the passage 133 when the conductive liquid is disposed in the passage 133 in the completed switch device. The grooves 138 provide a space adjacent to the heater 136 into which the actuating liquid enters to raise the efficiency of thermal transfer from the heater 136 to the actuating liquid. The groove 137 is not necessarily needed to move the actuating liquid through the passage 133 as long as the conductive liquid can be moved smoothly. This is because there are gaps between the inner surface of the passage 133 and the surface of the conductive drop that produce a similar effect. The grooves 137 and 138 may be formed simultaneously by reactive ion etching, for example. Rather than being formed in the glass substrate 120, the groove 138 may be formed by patterning the tantalum nitride film having a thickness of approximately 10 $\mu$m that also constitutes the heater 136.

In a third step, the two glass substrates 110 and 120 are assembled with the conductive liquid, the actuating liquid, and the actuating gas trapped between them. More specifically, the glass substrate 110 is first arranged with the cavities 131 and 132 and the passage 133 facing up. Then, $6.5\times10^6$ $\mu m^3$ of the actuating liquid and actuating gas, such as Freon, is divided roughly in half and a dispenser is used put the portions of actuating liquid into the cavities 131 and 132. By using a material such as Freon, which has good wettability with respect to the glass substrate 110, as the actuating liquid, a suitable quantity of the material is retained in the cavities 131 and 132. Additionally, $2\times10^6$ $\mu m^3$ of the conductive liquid, such as gallium, is placed in drops along the portion of the glass substrate 120 corresponding to the passage 133 in the glass substrate 110. Because the glass substrate 120 is not wetted by the gallium, the surface tension of the gallium causes the form of the drops to be nearly spherical. It is also possible to use mercury instead of gallium.

Next, the glass substrate 110 is turned over and positioned relative to the glass substrate 120. The two substrates are then pressed together. As the glass substrate 110 is turned over, it faces downward, but since the Freon has good wettability, the Freon is retained in the cavities 131 and 132. The gallium drops are held in the passage 133 of the substrate 110 by pressure. Epoxy resin is then applied around the edges of the glass substrate 110, and the glass substrate 110 is fixed to the glass substrate 120 to complete the switch device.

Assembly is preferably performed in a way that excludes gas other than Freon vapor from the cavities 11 and 12. The glass substrate 120 is preferably selected by taking into account its wettability by Freon. If the Freon does not spreadably wet the surface of the tungsten nitride heaters, then the required wettability can be obtained by forming a thin film of silicon oxide over the tantalum nitride.

Figure 6A:
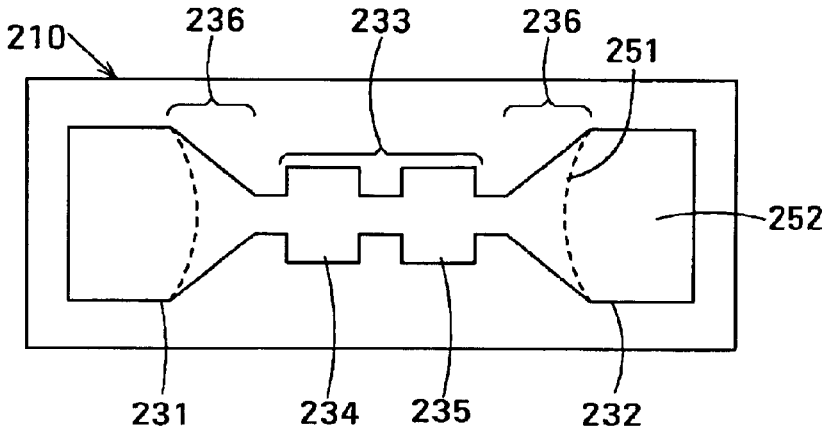
FIGS. 6A and 6B are plan views of the top and bottom, respectively, of glass substrates or sheets used in another switch device consistent the invention.
Figure 6B:
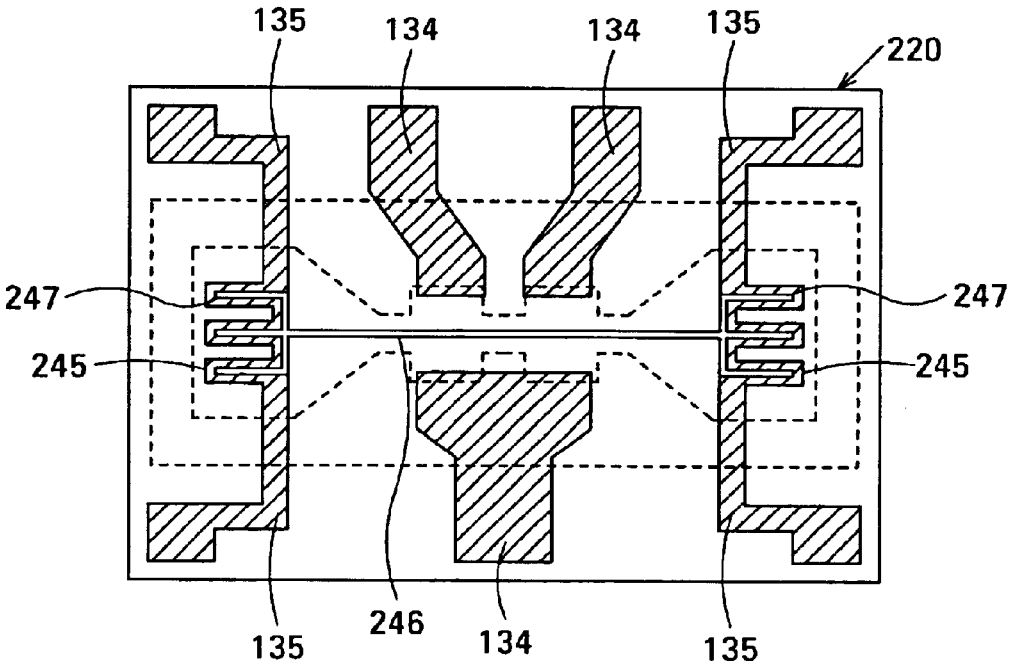

FIGS. 6A and 6B are diagrams of the glass substrates used in a switch device of a third aspect of the invention. FIG. 6A and FIG. 6B show the top and bottom glass substrate, respectively. This aspect of the invention is a variation of the second aspect of the invention, and elements shown in FIGS. 6A and 6B that are similar to elements shown in FIGS. 5A and 5B are indicated using the same reference numerals.

In this aspect of the invention, a switch device is also completed by putting the two glass substrates 210 and 220 together and tapping the actuating liquid, actuating gas, and conductive liquid between them. In particular, the cavities 231 and 232 are shaped to maintain a stable bubble state in an extremely low surface tension liquid even with liquid materials that will not spreadably wet surfaces of the cavities 231 and 232. As a result, it is unnecessary for the actuating liquid to exhibit spreadable wetting, which makes the selection of the actuating liquid easier. Specifically, the cavities 231 and 232 are shaped to include the tapered regions 236 that serve as constriction elements that constrain the expansion of the bubble in the cavity. The groove 246, which eases the flow of the actuating liquid, extends all the way to the heaters 245 and includes at either end a number of branch grooves 247 interleaved with the heater 245. Electrical traces 243 and the heaters 245 may be formed from nickel films with a thickness of 1 μm, and are formed to be interleaved with the branch grooves 247. This structure for the branch grooves 247 and the heater 245 provides effective thermal conduction from the heater 245 to the actuating liquid When the switch device is assembled, the actuating liquid 251 that can be vaporized so as to pool as a contiguous mass in the approximate center of the passage 233, as indicated by the broken lines FIG. 6A, and a substantially equal amount of actuating gas 252 is placed in the two cavities 231 and 232. Although not depicted in FIGS. 6A and 6B, a conductive liquid, such as mercury, gallium, or an alloy that includes gallium, is disposed in the passage 233. The conductive material is able to move in the same manner as described above, and can be latched in either of first and second chambers 234 and 235 provided along the passage 233, just as in the second aspect of the present invention.

The gas material that forms bubbles in the cavities 231 and 232 in the initial state may be nitrogen gas at approximately 0.2 atm. As discussed above, the liquid material 251 is placed as a contiguous mass in the center of the passage 233. However, since the groove 247, which is part of the groove 246, extends up to the proximity of the heater 245, the actuating liquid 251 flows to the proximity of the heater 245 through capillary action. This effectively brings about the vaporization of the actuating liquid. The groove 246 does not necessarily have to continue to the center if the movement of the mercury, gallium, or other conductive liquid is sufficiently smooth.

Figure 7A:
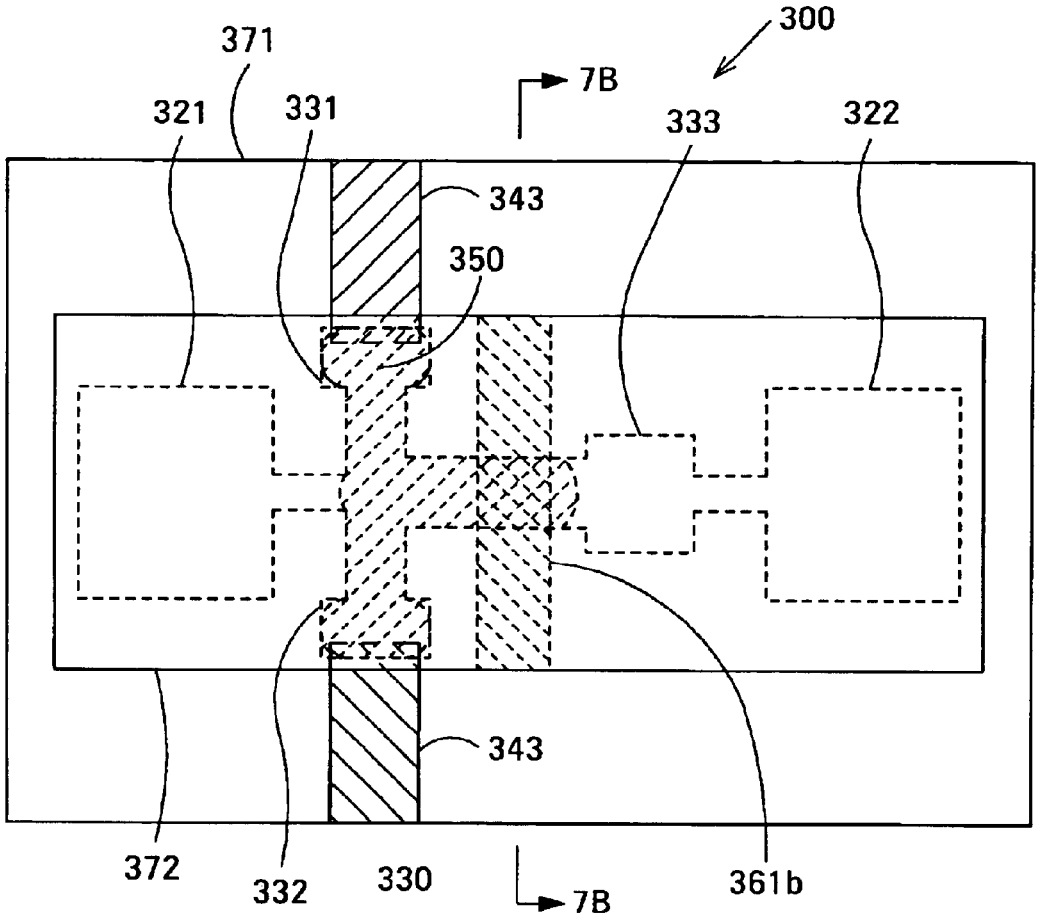
FIG. 7A is a plan view of another switch device consistent with the invention.
Figure 7B:
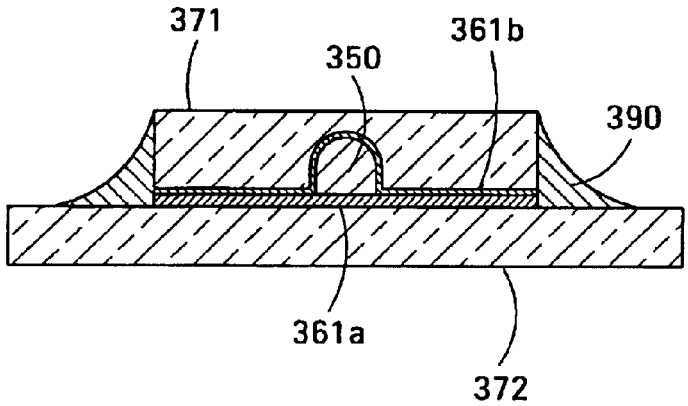
FIG. 7B is a cross section along the line 7B—7B in FIG. 7C.
Figure 7C:
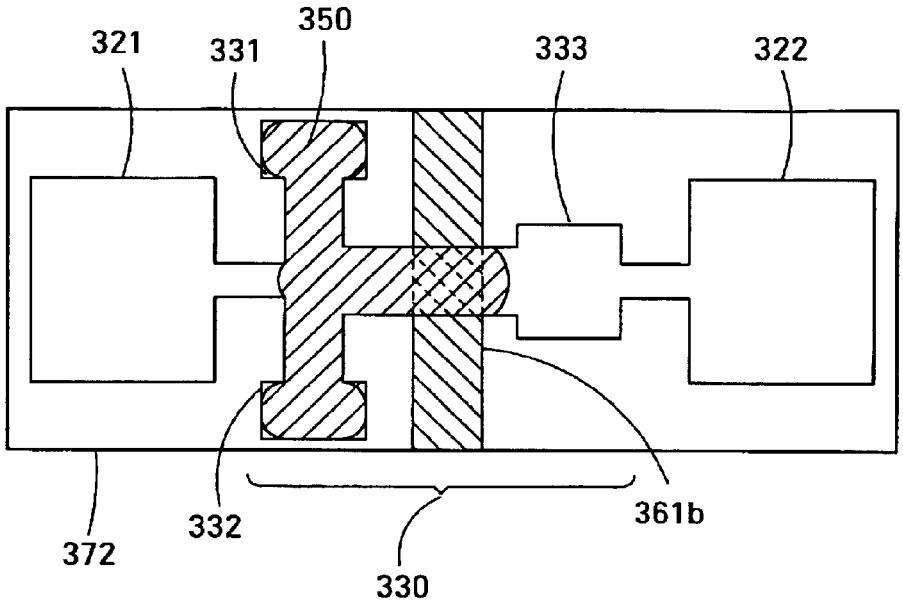
FIGS. 7C and 7D are plan views of the top and bottom, respectively, of glass substrates or sheets used in the switch device shown in FIGS. 7A and 7B.
Figure 7D:
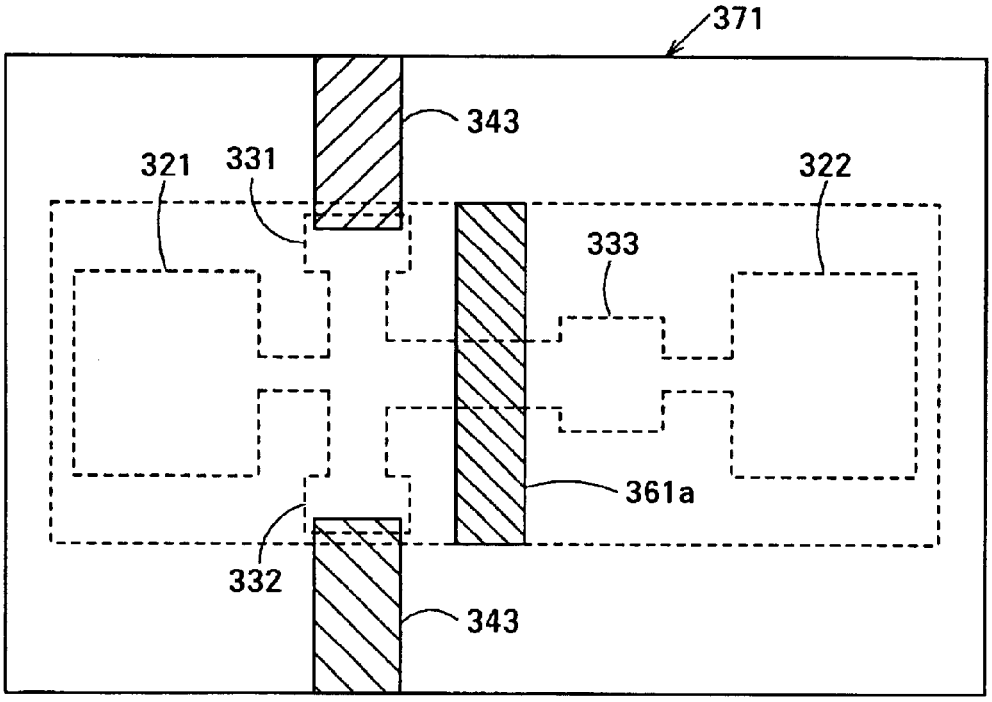

FIGS. 7A and 7B show a switch device 300 in a fourth aspect of the invention. FIG. 7A is a plan view of the completed switch device, FIG. 7B is a cross section along the line 7B—7B in FIG. 7A, and FIGS. 7C and 7D are top and bottom view of glass substrates used in the switch device shown in FIGS. 7A and 7B. As shown in FIG. 7B, the switch device 300 is also manufactured by assembling two glass substrates 371 and 372. The switch device 300 includes a pair of cavities 321 and 322, and an elongate passage 330 that extends between these cavities. The passage 330 includes first, second, and third chambers 331, 332, and 333.

In the initial state, a conductive liquid 350, which may be mercury, gallium or an alloy that includes gallium, is placed as a contiguous mass in the passage 330 to form an approximately T-shape extending into the first and second chambers 331 and 332 from the center of the passage 330. As shown in FIG. 7D, electrical traces 343 are located in each of the first and second chambers 331 and 332. The conductive liquid 350 shown in FIG. 7D acts to electrically connect the electrical traces 343 located in the chambers 331 and 332. The cavities 321 and 322 are similar to the cavities 11 and 12 described above.

Band-shaped nickel films 361*a* and 361*b* are located opposite one another on the surfaces of the substrates 371 and 372, respectively, at some point along the passage 330. After being put together, the two glass substrates 371 and 372 are bonded with epoxy resin 390. A slight gap may be left between the nickel films 361*a* and 361*b*, or a tight fit with no gap may be produced. The tight fit with no gap is preferable for the more effective action of the pressure. Effective operation of the switch device 300 is ensured when the conductive liquid has sufficiency good wettability with respect to nickel.

Band-shaped nickel films 361*a* and 361*b* are located opposite one another on the surface of the substrates 371 and 372 at some point along the passage 330. After being put together, the two glass substrates 371 and 372 are bonded with epoxy resin 390. A slight gap may be left between the nickel films 361*a* and 361*b*, or a tight fit with no gap may be produced. The tight fit with no gap is preferable for the more effective action of the pressure. Effective operation of the switch device 300 is ensured when the conductive liquid has sufficiently good wettability with respect to nickel.

Switch devices described above in the various aspects of the present invention are merely examples, and do not limit the present invention, which can be variously modified by a person skilled in the art. For example, it is also possible to manufacture more than one switch device on a single glass substrate, and a plurality of glass substrates can be laminated to create a switch device with a multilayer structure. In the former case in particular, a plurality of cavities can be radially linked to a single cavity, as shown in FIG. 8A, or a plurality of cavities can be concatenated.

Figure 8A:
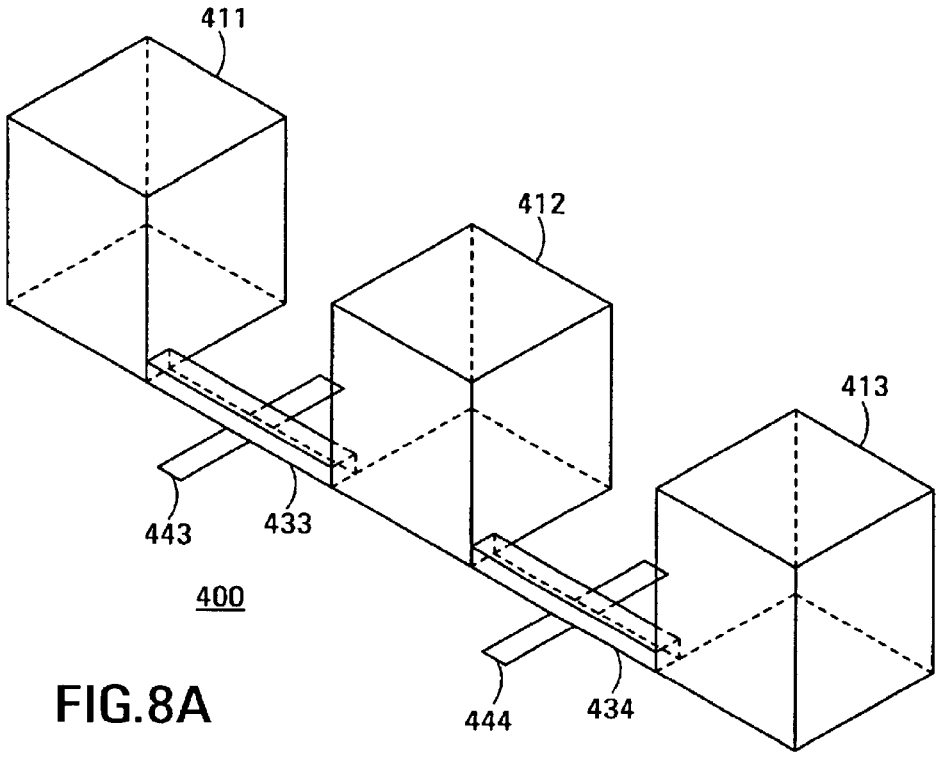
FIGS. 8A and 8B are perspective views of a simplified structure of another switch device consistent with the invention.

As shown in FIG. 8A, a switch device 400 includes a cavity 411 linked to a cavity 412 by a passage 433 and a cavity 413 linked to the cavity 412 by a passage 434. If the cavity 412 is heated, the state of the electrical paths, which include traces 443 and 444 disposed along the passages 433 and 434, respectively, are switched from being connected to disconnected, or vise versa.

Figure 8B:
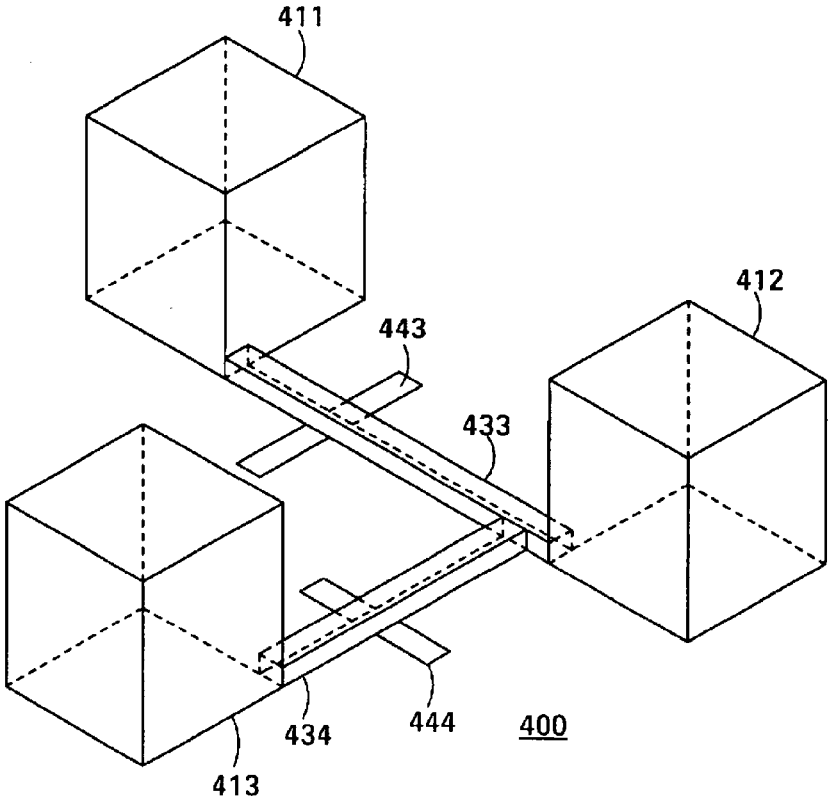

Furthermore, a plurality of cavities 411–413 may be linked to one another by a communicating portion located between them, as shown in FIG. 8B. In this case, the communicating portion can have a substantially radial structure or a branched structure, as shown by the passages 433 and 434 in the switch device 400 of FIG. 8B. A conductive liquid, such as a liquid metal, can be placed at an intersecting location so as to close off all of the passages or to close off the middle of all of the passages in this structure. In FIG. 8B, the electrical paths, which include traces 443 and 444 disposed along the passages 433 and 434, respectively, are switched between connected and disconnected states by heating the cavity 412.

Other materials can also be used in place of a glass substrate. Furthermore, in addition to Freon, the vaporizable actuating liquid may be other halogen-based materials, or alcohols, acetone, and other such materials.

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiment was chosen and described in order to explain the principles of the invention and as practical application to enable one skilled in the art to use the invention in various embodiments and with various modifications suited to the particular use contemplated. It is intended that the scope of the invention be defined by the claim appended hereto and their equivalents.

What is claimed is:

1. A switch device comprising:

first and second cavities;

a passage extending between the first and second cavities;

a conductive liquid located in the passage and movable in the passage;

an actuating liquid enclosed in each of the first and second cavities and covering inner surfaces of the first and second cavities, the actuating liquid being either an insulator or having low conductivity; and an actuating gas enclosed in each of the first and second cavities and existing as a bubble in each of the first and second cavities, the actuating gas being either an insulator or having low conductivity, wherein, in response to heating of the first cavity, part of the actuating liquid in the first cavity vaporizes and the actuating gas bubble in the first cavity expands, which causes part of the actuating liquid to be expelled out of the first cavity and the conductive liquid to move in the communicating passage such that an electrical path that includes the conductive liquid changes from one of a connected and a disconnected state to the other of the connected state and the disconnected state, and wherein the first cavity includes a constriction element shaped to constrain the expansion of the actuating gas bubble in the first cavity.

2. A switch device according to claim 1, wherein the expansion of the actuating gas bubble in the first cavity causes a portion of the boundary between the actuating gas and the actuating liquid in the first cavity to be deformed.

3. A switch device according to claim 2, wherein the deformation of the portion of the boundary results in a decreased radius of curvature of the portion of the boundary.

4. A switch device according to claim 3, wherein a surface tension force on the surface of the actuating gas bubble in the first cavity increases approximately proportionally to the decrease in the radius of curvature of the portion of the boundary.

5. A switch device according to claim 4, wherein the increased surface tension force acts to constrain the expansion of the actuating gas bubble and limit the expulsion of the actuating liquid from the first cavity into the passage.

6. A switch device according to claim 1, wherein the constriction element includes a tapered surface.

7. A switch device according to claim 6, wherein the expansion of the actuating gas bubble in the first cavity is constrained by the tapered surface of the first cavity.

8. A switch device according to claim 1, wherein the volume of the actuating gas bubble enclosed in each of the first and second cavities is set to be greater than a volume of the actuating liquid enclosed in each of the first and second cavities, and the volume of the actuating gas bubble in the second cavity decreases in response to the heating of the first cavity.

9. A switch device according to claim 1, wherein the actuating liquid is selected from the group consisting of Freon, methanol, ethanol, ethyl bromide, acetone, and cyclohexane.

10. A switch device according to claim 1, wherein the actuating gas comprises the same substance as the actuating liquid.

11. A switch device according to claim 1, wherein the conductive liquid comprises a liquid metal material.

12. A switch device according to claim 11, wherein the liquid metal material comprises one of gallium, an alloy including gallium, and mercury.

13. A switch device according to claim 1, wherein the actuating gas comprises a material of a different substance from that of the actuating liquid.

14. A switch device according to claim 1, wherein at least one of the first and second cavities includes:

a heater for heating and vaporizing the actuating liquid; and a groove into which the actuating liquid flows located in the proximity of the heater.

15. A switch device according to claim 14, wherein the groove is additionally disposed along a longitudinal outer surface of the passage and is in communication with the passage.

16. A switch device according to claim 14, wherein the surface of the heater is formed from a material that can be wetted by the actuating liquid.

17. A switch device according to claim 1, further comprising:

a third cavity; and a second communicating passage extending between the first and third cavities, wherein the conductive liquid is additionally located in the second passage and is movable therein, wherein the actuating liquid and the actuating gas are further enclosed in the third cavity in the same manner as in the first and second cavities, and wherein, in response to the heating of the first cavity, the conductive liquid in the second passage moves such that a second electrical path that includes the conductive liquid in the second communicating passage changes from one of a connected and a disconnected state to the other of the connected state and the disconnected state.

18. A method for switching an electrical path in a switch device comprising first and second cavities, the first cavity including a constriction element, a passage extending between the first and second cavities, a conductive liquid located in the passage and movable therein, an actuating liquid enclosed in each of the first and second cavities and covering inner surfaces thereof, the actuating liquid being either an insulator or having low conductivity, an actuating gas enclosed in each of the first and second cavities and existing as a bubble therein, the actuating gas being either an insulator or having low conductivity, the method comprising:

vaporizing part of the actuating liquid in the first cavity and expanding the actuating gas bubble in the first cavity in response to heating of the first cavity, constraining the expansion of the actuating gas bubble in the first cavity with the shape of the constriction element;

expelling part of the actuating liquid from the first cavity in response to the expansion of the actuating gas bubble in the first cavity; and moving the conductive liquid in response to the expulsion of part of the actuating liquid from the first cavity to put an electrical path that includes the conductive liquid from one of a connected and a disconnected state to the other of the connected state and the disconnected state.

19. A method according to claim 18, in which constraining the expansion of the actuating gas includes deforming a portion of the boundary between the actuating gas and the actuating liquid in the first cavity in response to the expansion of the actuating gas bubble in the first cavity.

20. A method according to claim 19, wherein the deforming of the portion of the boundary decreases a radius of curvature of the portion of the boundary.

21. A method according to claim 20, wherein the decreasing of the radius of curvature increases a surface tension force on the surface of the actuating gas bubble in the first cavity approximately proportionally to the decreasing of the radius of curvature.

22. A method according to claim 21, wherein the increased surface tension force constrains the expansion of the actuating gas bubble and limits the expulsion of the actuating liquid from the first cavity into the passage.

23. A method according to claim 18, wherein the constriction element includes a tapered surface.

24. A method according to claim 23, wherein the expansion of the actuating gas bubble in the first cavity is constrained by the tapered surface of the first cavity.

25. A method according to claim 18, additionally comprising:

setting the volume of the actuating gas bubbles enclosed in each of the first and second cavities to be greater than a volume of the actuating liquid in the first and second cavities, and decreasing the volume of the bubble in the second cavity in response to the heating of the first cavity.

26. A method according to claim 18, wherein the actuating liquid is selected from the group consisting of Freon, methanol, ethanol, ethyl bromide, acetone, and cyclohexane.

27. A method according to claim 18, wherein the actuating gas comprises the same substance as the actuating liquid.

28. A method according to claim 18, wherein the conductive liquid comprises a liquid metal material.

29. A method according to claim 28, wherein the liquid metal material comprises one of gallium, an alloy including gallium, and mercury.

30. A method according to claim 18, wherein the actuating gas comprises a material of a different substance from that of the actuating liquid.

* * * * *